US010586525B1

(12) United States Patent
D'Antonio et al.

(10) Patent No.: US 10,586,525 B1
(45) Date of Patent: Mar. 10, 2020

(54) ARRAY OF ACOUSTICAL RETURNER DEVICES TO REFLECT SOUND BACK IN THE INCIDENT DIRECTION

(71) Applicant: RPG ACOUSTICAL SYSTEMS LLC, Passaic, NJ (US)

(72) Inventors: Peter D'Antonio, Bowie, MD (US); Jeffrey S. Madison, Wallingford, PA (US)

(73) Assignee: RPG Acoustical Systems, LLC

( * ) Notice: Subject to any disclaimer, the term of this patent is extended or adjusted under 35 U.S.C. 154(b) by 0 days.

(21) Appl. No.: 16/444,293

(22) Filed: Jun. 18, 2019

(51) Int. Cl.
*G10K 11/20* (2006.01)
*G10K 11/162* (2006.01)

(52) U.S. Cl.
CPC ..... *G10K 11/20* (2013.01); *G10K 11/162* (2013.01)

(58) Field of Classification Search
CPC ..... G10K 11/162; G10K 11/20
USPC ..... 181/286, 30
See application file for complete search history.

(56) References Cited

U.S. PATENT DOCUMENTS 3,592,289 A * 7/1971 Aysta ..... E04B 2/7429 160/135
4,356,880 A * 11/1982 Downs ..... E04B 1/99 181/286
4,548,292 A * 10/1985 Noxon ..... E04B 1/84 181/286
4,605,093 A * 8/1986 Karlen ..... E04B 1/8218 181/286
5,137,111 A * 8/1992 Diduck ..... E04B 1/8209 181/286
5,403,979 A * 4/1995 Rogers ..... E04B 1/8236 181/287
5,992,561 A * 11/1999 Holben ..... E04B 1/84 181/295
7,921,960 B2 * 4/2011 Jacobson ..... A47B 63/00 181/194
2008/0264720 A1 * 10/2008 Vigran ..... E04B 1/86 181/286

* cited by examiner

*Primary Examiner* — Forrest M Phillips
(74) *Attorney, Agent, or Firm* — H. Jay Spiegel

(57) ABSTRACT

A plurality of tri-rectangular tetrahedrons are mounted in an array to reflect sound waves back to their source. The array filters out the acoustic range below the normal range of frequencies for the spoken voice. The array is combined with a sound absorber to absorb frequencies the user does not want to have returned to the source. One example of such absorbers consists of rendering the returner somewhat porous with microperforations or microslits so that sound waves below the desired frequency range can travel through the porosity and into an absorbing area which may include fiberglass or other sound absorbing fabrics. Examples of environments of use for the present invention are an office setting or nursing station in which a large room is divided up into spaces or cubicles by partitions. Acoustical returners can be mounted above each space or cubicle, for example, in ceiling mounted arrays or clouds above each space or cubicle.

29 Claims, 8 Drawing Sheets

An array of Trirectangular tetrahedra

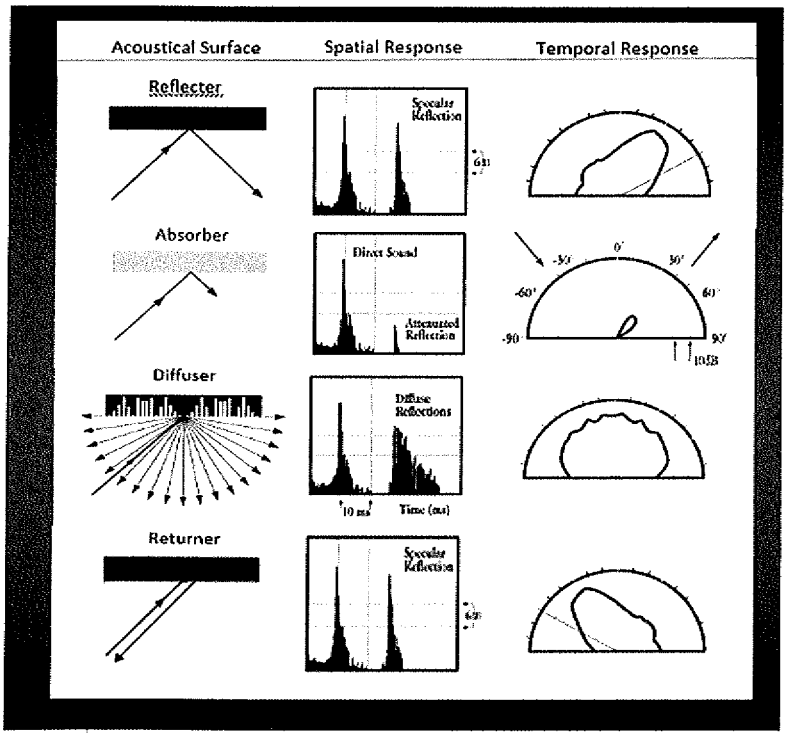
*Figure 1. Acoustical surface temporal land spatial responses*
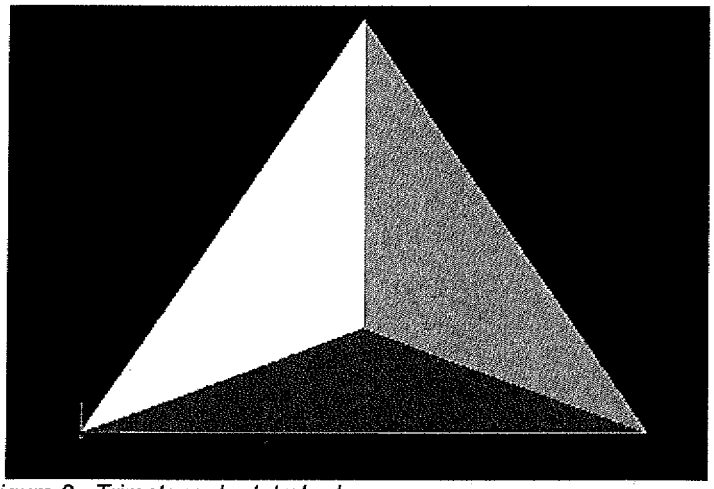
*Figure 2. Trirectangular tetrahedron*

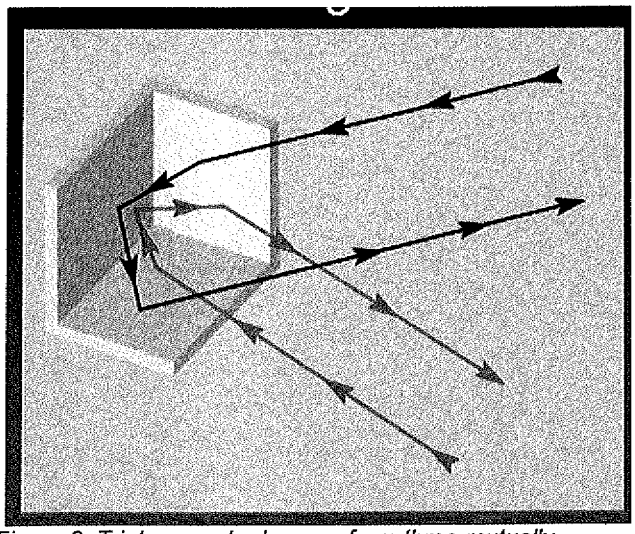
*Figure 3. Triple specular bounce from three mutually perpendicular planes*
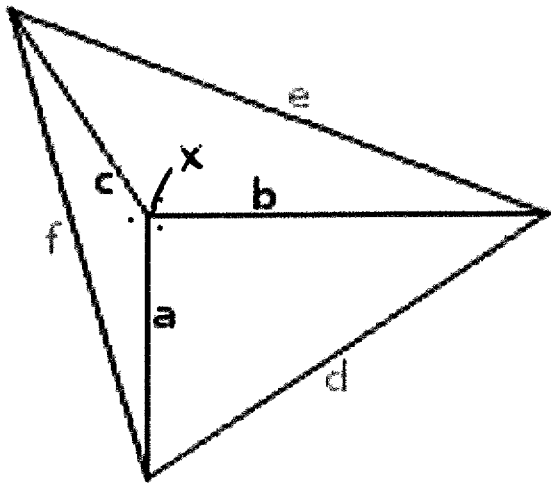
*Figure 4. Sides and base parameters of a Tri-rectangular tetrahedron*

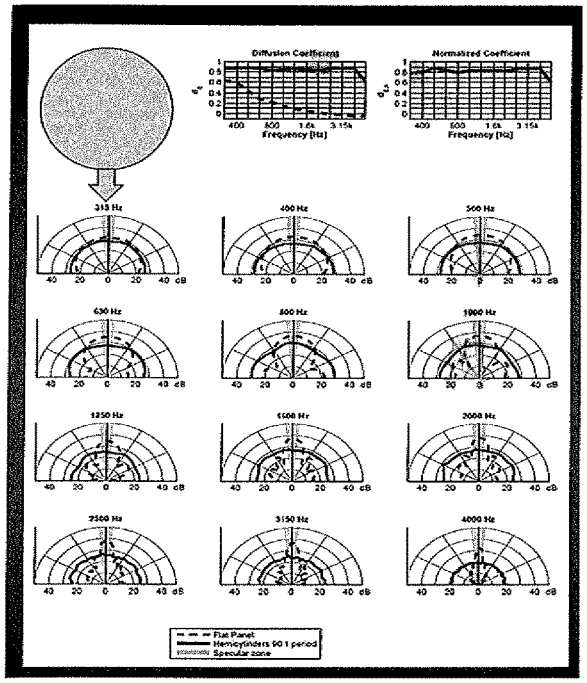
Figure 5. Polar response and diffusion coefficient for normal incidence sound on a cylinder
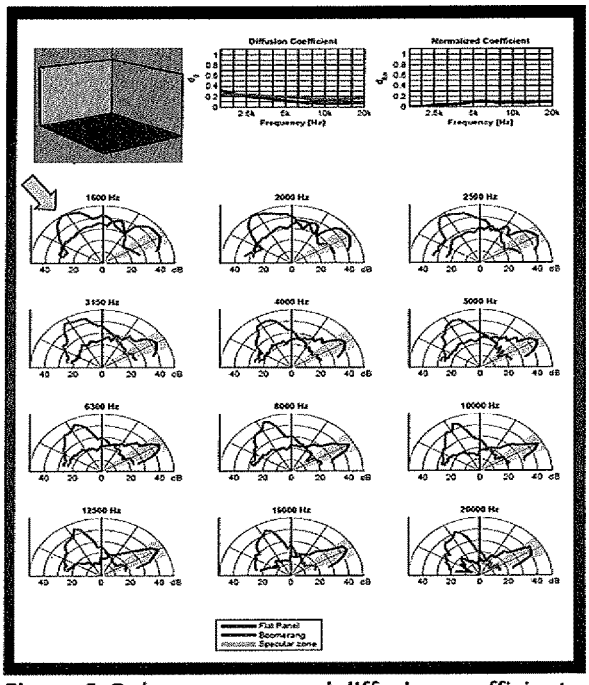
Figure 6. Polar response and diffusion coefficient for oblique incident sound on the present invention

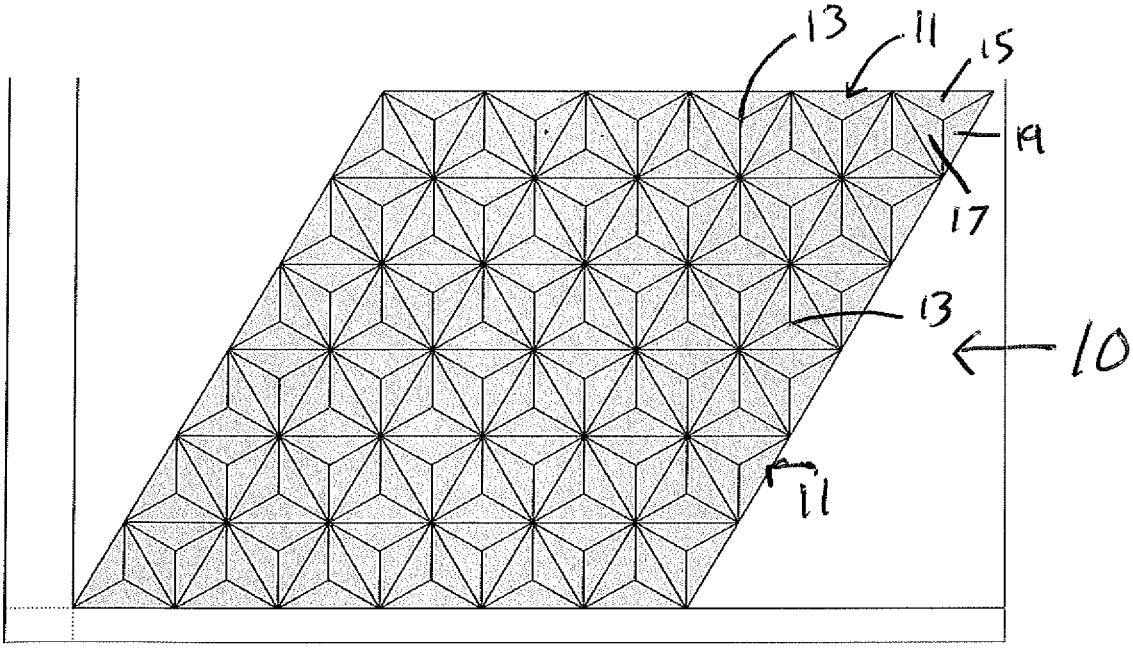
Figure 7. An array of Trirectangular tetrahedra
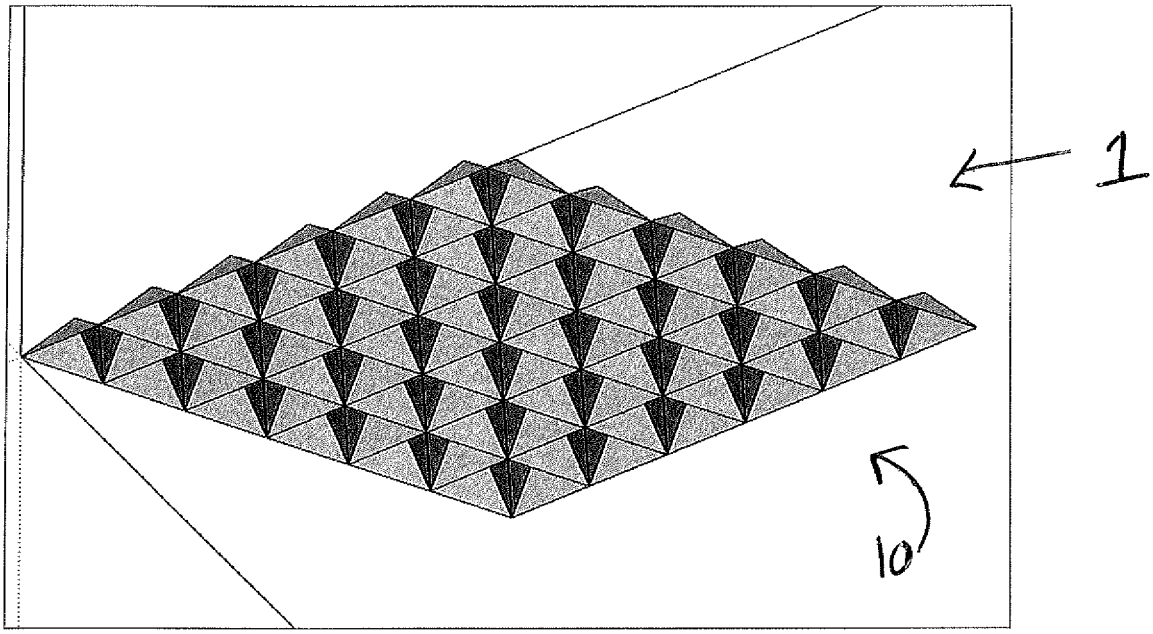
Figure 8. Array of Trirectangular tetrahedra in a ceiling

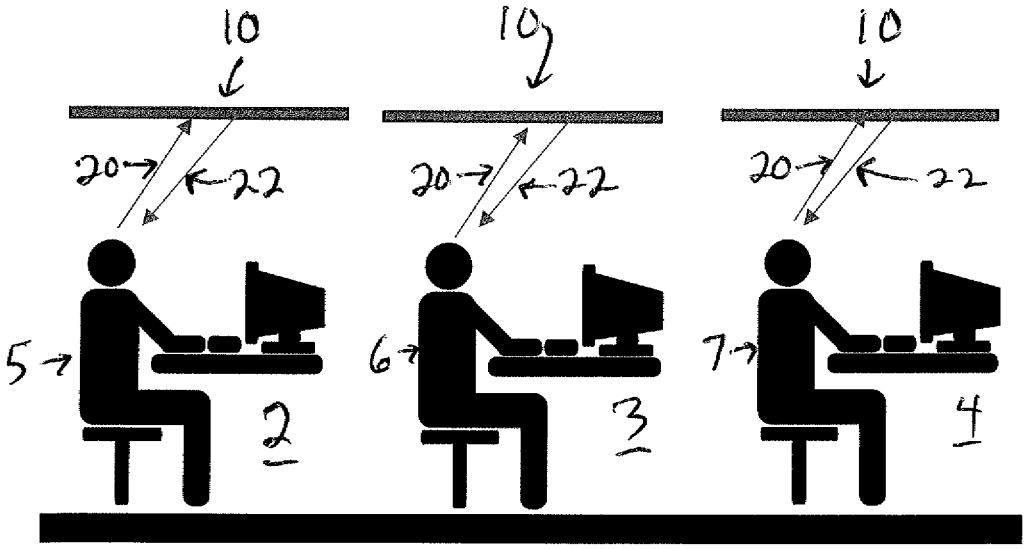
*Figure 9. Three returner clouds over three workstations returning speech back in the direction of the source*
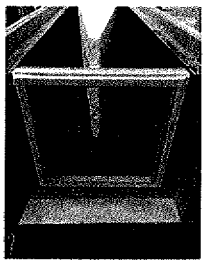
Test sample: CPMicroperf
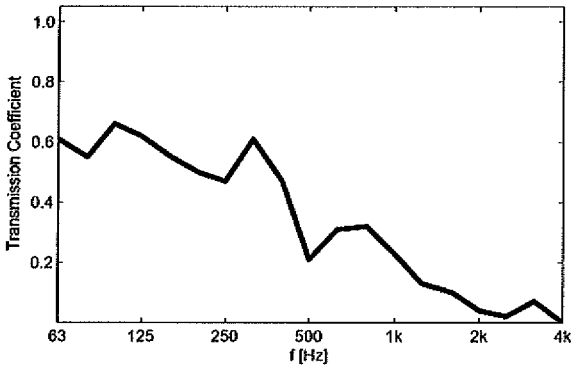
| f [Hz] | 63 | 80 | 100 | 125 | 160 | 200 | 250 | 315 | 400 | 500 | 630 | 800 | 1k | 1.25k | 1.6k | 2k | 2.5k | 3.15k | 4k |
|---|---|---|---|---|---|---|---|---|---|---|---|---|---|---|---|---|---|---|---|
| % | 61 | 55 | 66 | 62 | 55 | 50 | 47 | 61 | 47 | 21 | 31 | 32 | 23 | 13 | 10 | 4 | 2 | 7 | 0 |
*Figure 10. Transmission coefficient of 5 mm microperforated acrylic*

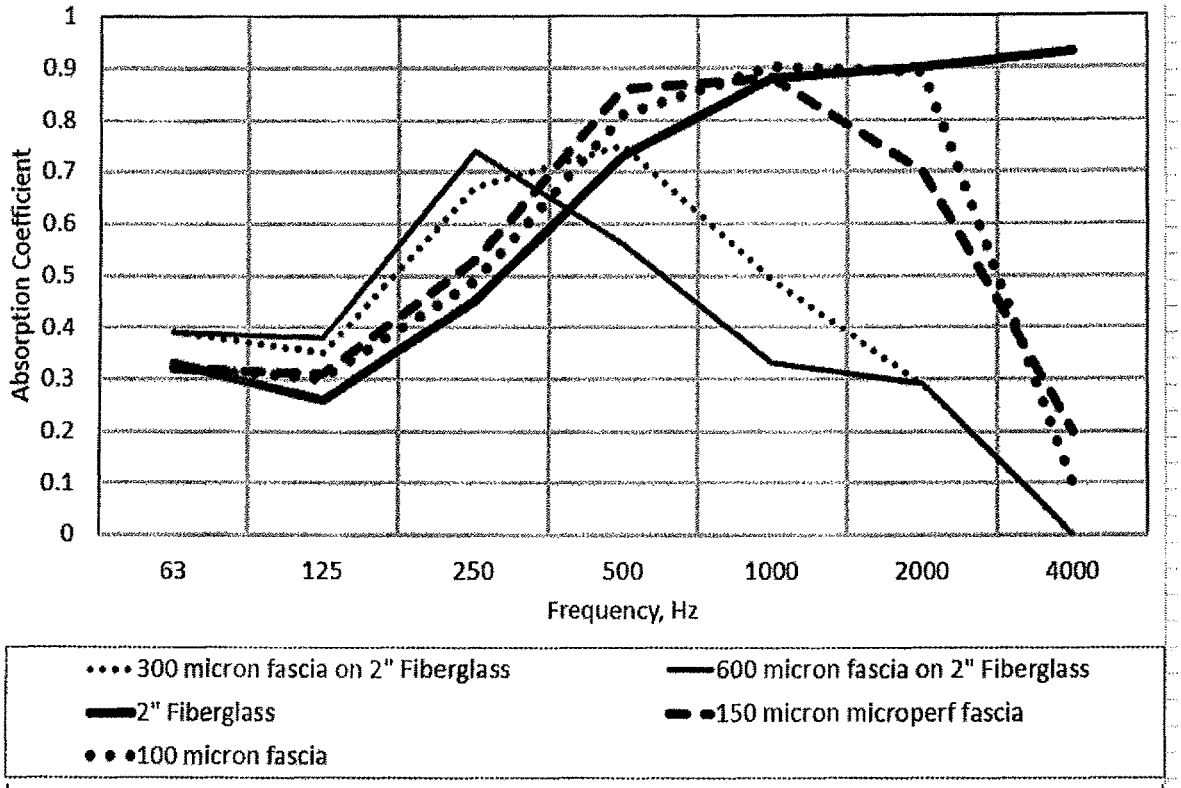
*Figure 11. Absorption coefficient of 2" of fiberglass covered with various fascia*

ARRAY OF ACOUSTICAL RETURNER DEVICES TO REFLECT SOUND BACK IN THE INCIDENT DIRECTION

BACKGROUND OF THE INVENTION

The present invention relates to an array of acoustical returner devices to reflect sound back in the incident direction. The acoustics of a room are controlled by the room's shape and volume, as well as reflections from surface treatments and the room's contents. Traditionally, sound absorbing and reflecting surfaces were used to control reflections. In 1984, co-Applicant Dr. Peter D'Antonio introduced the reflection phase grating into the pantheon of surface treatments. These surfaces were based on mathematical number theory sequences and numerical optimization and uniformly scattered the incident sound over a wide range of desirable frequencies for any angle of incidence. The present invention teaches a new addition to the toolbox of acoustical surface treatments. It is based on the tri-rectangular tetrahedron geometric shape and has the unique ability to return incident sound back in the direction of incidence, like a boomerang. A tetrahedron is a pyramid having four planar triangular faces. The tri-rectangular tetrahedron consists of three mutually perpendicular faces forming a corner.

Tri-rectangular tetrahedrons are generally known and are often referred to as corner reflectors. Such corner reflectors are known for use in reflecting light or electromagnetic radiation directly back to their source. The present invention contemplates using a tri-rectangular tetrahedron to reflect sound waves back to their source. Additionally, the present invention contemplates a filtering aspect that allows concentration of the reflected arrays solely to the bandwidth of the spoken word. This combination of aspects is not known in the prior art.

SUMMARY OF THE INVENTION

The present invention relates to an array of acoustical returner devices to reflect sound back in the incident direction. The present invention includes the following interrelated objects, aspects and features:

(1) In a first aspect, the present invention contemplates the use of tri-rectangular tetrahedrons or corner reflectors connected in an array in order to reflect sound waves back to their source.

(2) In an important aspect, the present invention is designed to filter out the frequencies which do not contribute to and can mask the understanding of speech (referred to as speech intelligibility). The power of speech is delivered in the vowels (a, e, i, o, u and sometimes y) which are predominantly in the frequency range of 250 Hz to 500 Hz. More importantly, speech intelligibility is delivered in the consonants (b, c, d, f, g, h, j, k, l, m, n, p, q, r, s, t, v, w), which requires information at 2,000 Hz to 6,000 Hz and above. If the frequencies at 500 Hz and below predominate, due to excessive reverberation, for example, these frequencies can mask the consonants and corrupt intelligibility. In addition, typical treatments of absorbing material on the ceiling of the room, in the form of typical ceiling tiles or fabric wrapped panels, may excessively reduce the high-frequency consonant sounds and result in the masking of high-frequency consonants by low-frequency vowel sounds. Simply adding large amounts of high frequency absorption to the room to achieve short reverberation times also leads to reduced Signal to Noise (SNR) values and degraded speech intelligibility, due to reduced sound levels. The ceiling area is very important to provide useful early reflections. Therefore, this invention describes a method to not only filter the voice frequencies to enhance speech intelligibility, but also redirects the important early reflections back to their source, which improves the signal-to-noise ratio (SNR) and speech intelligibility, to provide passive amplification and reduce interference to neighboring locations.

(3) There are numerous ways in which frequencies outside a desired range can be filtered. For example, an array of acoustical returners in accordance with the teachings of the present invention can be combined with sound absorbers to absorb frequencies the user does not want to have returned to the source. One example of such absorbers consists of rendering the returners somewhat porous so that sound waves below the desired frequency range can travel through the porosity and into an absorbing area which may include fiberglass or other sound absorbing fabrics.

(4) One type of device that can provide the absorption of undesired frequencies consists of a hard panel that includes micro-slits therethrough. Two examples of micro-slits are those disclosed in U.S. Pat. No. 10,068,563 to D'Antonio et al. which was issued on Sep. 4, 2018. Another example is disclosed in U.S. Pat. No. 7,677,359 to Vigran et al. These two patents disclose differing types of micro-slits used as a sound absorber and either could be employed in accordance with the teachings of the present invention.

(5) Examples of environments of use for the present invention are an office setting or nursing station in which a large room is divided up into spaces or cubicles by partitions. Acoustical returners in accordance with the teachings of the present invention can be mounted above each space or cubicle, for example, in ceiling mounted arrays or clouds above each space or cubicle. A person within the space or cubicle speaking on the phone or with others will have his or her words returned back to them and passively amplified with extraneous sounds filtered out. In this way, the speaker will hear his or her words loudly and this will encourage them to speak more softly so as not to disrupt workers in adjacent spaces or cubicles.

(6) In a further aspect, arrays of acoustical returners can be mounted in surrounding relation to a computer display so that if a worker within a cubicle is speaking in the direction of the display, his or her words are acoustically returned by the array in a passively amplified manner, thereby encouraging the speaker to speak more softly.

(7) As such, it is a first object of the present invention to provide an acoustical surface which consists of three mutually perpendicular planes to redirect incident sound from any direction, back into the incident direction.

(8) It is a further object of the present invention to utilize various polygons, e.g., squares, rectangles, triangles, etc. to form the three mutually perpendicular planes.

(9) It is a further object of the present invention to form multi-element arrays to form a plane surface directing incident sound back in the incident direction.

(10) It is a further object of the present invention to utilize this multi-element array in applications in which benefit from this unique "boomerang" capability, like an office or teleconference environment in which the redirected sound to the speaker will passively amplify their speech and encourage them to lower their voice, thus creating less of a noise disturbance to nearby workers.

(11) It is a further object of the present invention to create zones in which no sound is allowed to reflect to other areas, thereby performing the action of an absorber, but instead of removing the sound, the invention captures the sound for constructive use.

(12) It is a further object of the present invention to take advantage of the psychoacoustic effect of reducing self-made sound by passively increasing its volume to the source, e.g., a practicing instrumentalist or vocalist can hear oneself more clearly when the emitted sound is returned rather than scattered or absorbed.

(13) It is a further object of the present invention to design the surface to redirect a certain useful frequency bandwidth and transmit or absorb unwanted frequencies.

(14) It is a further object of the present invention to utilize transparent, translucent, and solid, microperforated or microslitted materials to achieve the desired functionality.

These and other aspects, objects and features of the present invention will be better understood from the following detailed description of the preferred embodiments when read in conjunction with the appended drawing figures.

BRIEF DESCRIPTION OF THE DRAWINGS

FIG. 1 shows a display of the spatial response and temporal response for reflectors, absorbers, diffusers, and returners.

FIG. 2 shows a front view of a tri-rectangular tetrahedron.

FIG. 3 shows a schematic representation of how sound is reflected back to the source when received within a tri-rectangular tetrahedron.

FIG. 4 shows the sides and base parameters of a tri-rectangular tetrahedron.

FIG. 5 shows a schematic representation of the polar response and diffusion coefficient for normal incident sound on a cylinder.

FIG. 6 shows the polar response and diffusion coefficient for oblique incident sound with respect to the present invention.

FIG. 7 shows an array of tri-rectangular tetrahedra.

FIG. 8 shows the array of FIG. 7 but mounted above a space.

FIG. 9 shows a schematic representation of a plurality of adjacent workstations with returner clouds in accordance with the teachings of the present invention mounted above each workstation.

FIG. 10 shows a graph of the transmission coefficient of 5 mm microperforated acrylic.

FIG. 11 shows a graph of the absorption coefficient of fiberglass covered with various fascia.

SPECIFIC DESCRIPTION OF THE PREFERRED EMBODIMENTS

Figure 12:
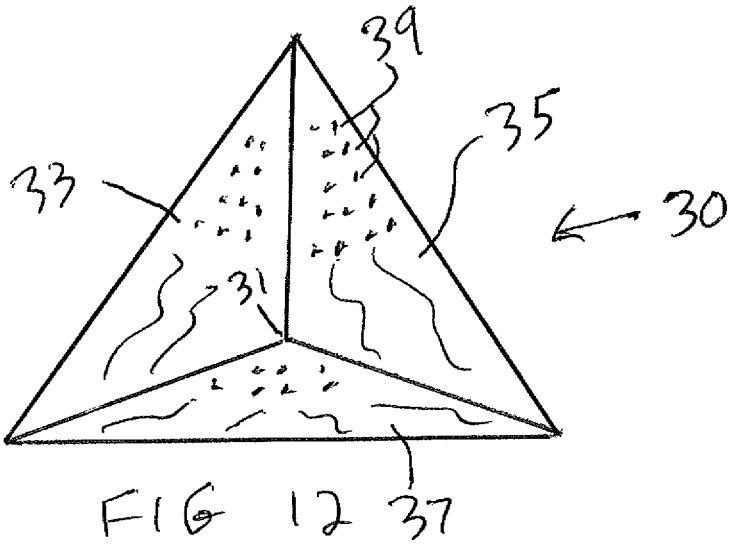
FIG. 12 shows an opaque tri-rectangular tetrahedron which includes a multiplicity of microperforations.

With reference first to FIG. 1, a chart is shown which provides the spatial response and temporal response for four types of acoustical treatments. Those types are reflectors, absorbers, diffusers, and returners. As seen in FIG. 1, in a reflector, incident sound is reflected forward at an angle corresponding to the angle of incidence. The ideal reflector reflects as much of the sound as is possible. In an absorber, a percentage of the incident sound is absorbed by the absorber so that sound emanating from the absorber is reduced particularly in amplitude. A diffuser takes incident sound and diffuses it, preferably uniformly about a listening room. A returner returns the sound back to its source. The present invention is concerned with returners.

FIG. 2 shows a front view of a tri-rectangular tetrahedron. As shown in FIG. 2, such a device is made up of walls having three mutually perpendicular surfaces. In FIG. 2, those surfaces consist of triangles.

With reference to FIG. 4, the tri-rectangular tetrahedron of FIG. 2 is labeled with letters, with the letters a, b and c comprising the mutually perpendicular lines that meet at an apex x. The letters d, e and f describe the peripheral terminations of the triangular surfaces and together define the forward facing opening thereof.

With further reference to FIG. 4, the design parameters for a surface of height h are calculated using the formulas identified below with the numbers (1), (2), (3) and (4).

$$d = \sqrt{a^2 + b^2} \tag{1}$$

$$e = \sqrt{b^2 + c^2} \tag{2}$$

$$f = \sqrt{a^2 + c^2} \tag{3}$$

$$h = \sqrt{\frac{1}{\left\{\frac{1}{a^2} + \frac{1}{b^2} + \frac{1}{c^2}\right\}}} \tag{4}$$

FIG. 3 shows a tri-rectangular tetrahedron showing two examples of incident sound waves being reflected back in the direction of the source of the sound waves.

FIGS. 5 and 6 compare the polar response and diffusion coefficient for a cylinder and a corner reflector. FIGS. 5 and 6 demonstrate that a cylinder is a near perfect diffuser, whereas a corner reflector, as expected, reflects incident sound back to its source. In FIG. 6, the sound is incident at 60 degrees to the surface normal over a bandwidth of 1,600 to 20,000 Hz. As shown in FIG. 5, the normalized diffusion coefficient can be seen to be nearly 1 at all frequencies indicating that a single cylinder is a near perfect diffuser. By comparison, with reference to FIG. 6, the normalized diffusion coefficient for a corner reflector is near 0 at all measured frequencies.

As particularly shown in FIG. 6, the described surface returns the sound back in the incident direction over a bandwidth of from 1,600 Hz to 20,000 Hz for the given design. The normalized diffusion coefficient can be seen to be essentially 0 over this bandwidth, verifying that the invention does not diffuse sound but redirects it back in the direction of the source. To ensure specular reflection from each of the three mutually perpendicular planes, the diagonal d (FIG. 4) must be equal to or greater than two wavelengths at the lowest design frequency $f_{min}$ where c is the speed of sound in accordance with the following formula:

$$d \geq \frac{2c}{f_{min}}$$

With reference to FIG. 7, an array of tri-rectangular tetrahedra is shown. The array 10 includes a multiplicity of tri-rectangular tetrahedra 11, each of which includes an apex 13 and three mutually perpendicular sides 15, 17 and 19.

In FIG. 8, the array 10 shown in FIG. 7 is shown mounted above a space, for example, in a ceiling 1 facing directly downward. FIG. 9 shows a plurality of workstations 2, 3 and 4 with an array 10 of tri-rectangular tetrahedra located above each workstation. As shown in FIG. 9, incident sound waves 20 are reflected directly back to the source as designated by the reference numeral 22. A person 5, 6 or 7 sitting at the respective workstations 2, 3 or 4 speaks and their speech is reflected by the array 10 back to them so that they can hear themselves speak. At the same time, the array 10 assists in preventing their speech from emanating to the next adjacent cubicle and disturbing its occupant. The array 10 provides passive amplification which, to the speaker, makes it sound like they are speaking more loudly than they are speaking, which typically results in the speaker reducing the amplitude of their speech which also assists in precluding disturbing their adjacent neighbor.

There are three main choices of materials for the array 10. A first possibility is a hard surface that reflects all incident sound back to the source. This is the least desirable embodiment because it reflects all the sound waves including low frequencies below the bottom frequency of speech which can cause confusion to the speaker when his or her speech is reflected directly back to them. A second alternative is an opaque surface perhaps made of wood or other material but covered with microperforations which receive sound waves and, in effect, filter out the low frequency sounds below the bottom frequency of speech. A third alternative is to make the array 10 out of a transparent or translucent material that is covered with microslits which perform a similar sound filtering feature as is the case with the opaque surfaces covered with microperforations. The advantage of making the array translucent or transparent is that it can be mounted beneath a light fixture so that light can be transmitted therethrough. As explained earlier, co-Applicant D'Antonio is a co-inventor in U.S. Pat. No. 10,068,563 which covers microslits having wedge-shaped configuration formed in a substantially transparent surface.

FIG. 12 shows a tri-rectangular tetrahedron made of an opaque material such as wood and covered with microperforations in a desired pattern. The tetrahedron is designated by the reference numeral 30 and has an apex 31, walls 33, 35 and 37 with mutually perpendicular surfaces, and microperforations 39.

Figure 13:
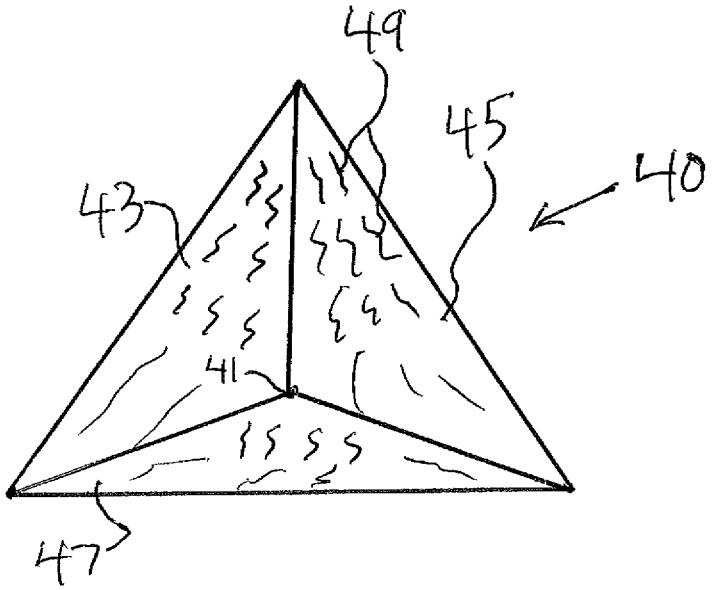
FIG. 13 shows a transparent or translucent tri-rectangular tetrahedron which includes a multiplicity of microslits.

FIG. 13 shows a tri-rectangular tetrahedron that is made of a transparent or translucent material such as plastic or glass and covered with a multiplicity of microslits. The tetrahedron of FIG. 13 is designated by the reference numeral 40 and has an apex 41, walls 43, 45 and 47 with mutually perpendicular surfaces, and microslits 49. The microslits may have a wedge-shaped configuration as taught by U.S. Pat. No. 10,068,563 or may have a uniform cross-section from front to rear as taught by U.S. Pat. No. 7,677,359 to Vigran et al. However, Applicants note that neither of these issued patents teach the concepts of the present invention, namely, use of an array of corner reflectors to reflect incident sound back to its source and including filtration of low frequency sound waves.

Figure 15:
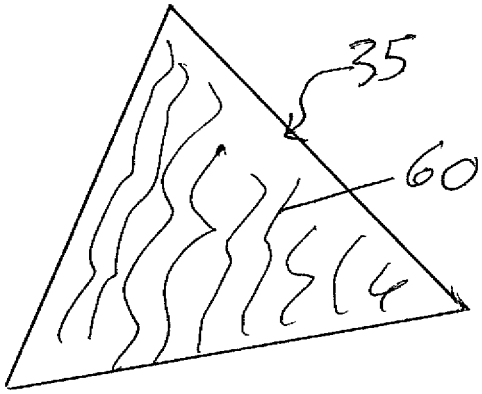
FIG. 15 shows a rear view of one of the walls of a tri-rectangular tetrahedron covered with sound absorbing fabric.

FIG. 15 shows a representative rear view of a wall of a tri-rectangular tetrahedron, in this case the wall having front surface 35 (FIG. 12), the rear surface thereof shown covered with a sound absorbing fabric 60 such as, for example, fiberglass.

FIG. 10 illustrates how a 5 mm acrylic panel with microperforations will transmit the low frequencies, thus removing them from the source area, while allowing the higher frequencies at 500 Hz and above to be reflected back to the source direction in accordance with the teachings of the present invention, thus providing passive amplification, filtration of frequencies below the spoken word, and improved speech intelligibility.

FIG. 11 shows a graph of absorption coefficient versus frequency for a variety of materials as shown. FIG. 11 demonstrates that as the fascia thickness is increased from 300 to 600 microns, more high frequencies are reflected, and lower frequencies are transmitted and absorbed by the porous backing, thereby adding passive amplification in the frequency range where consonants are important for intelligibility.

Applicants note that another practical application for the array 10 is in healthcare nursing stations in which overhead and vertical arrays can be used to confine all the noise in a local area and minimize intrusion of sound into patient rooms and other locations outside the nursing stations.

The overhead mounted array 10, otherwise described as "clouds" can be used in transportation and hospitality reservation desks to passively amplify speech in the locality of the parties involved to increase intelligibility without the need to shout and without interfering with conversations between other guests. Additionally, arrays such as the array 10 can also be used in stage shells for musical rehearsal and performance. In such an environment, musicians will be better able to hear themselves and diffusers can also be employed so that such musicians can hear contributions from the entire ensemble.

Figure 14:
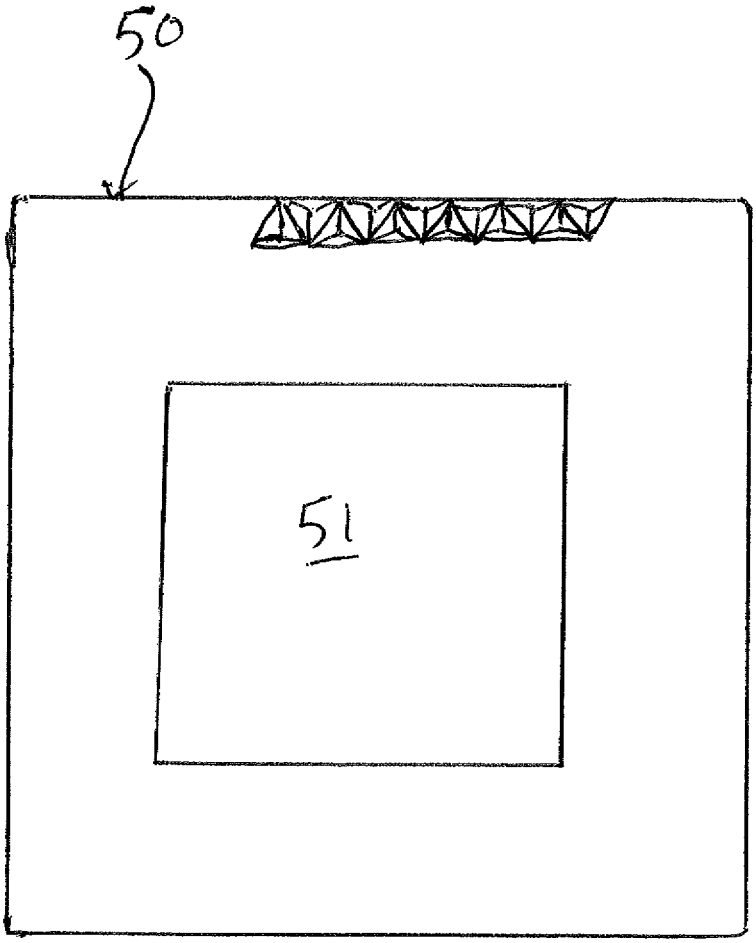
FIG. 14 shows an array of tri-rectangular tetrahedrons surrounding a computer display.

FIG. 14 shows an array 50 of tri-rectangular tetrahedrons mounted surrounding a computer display 51. The user speaking while facing the display will have his or her speech passively amplified and reflected back to him or her.

As such, an invention has been disclosed in terms of preferred embodiments thereof which fulfill each and every one of the objects of the invention as set forth hereinabove, and provide a new and useful array of acoustical returners device to reflect sound back in the incident direction of great novelty and utility.

Of course, various changes, modifications and alterations in the teachings of the present invention may be contemplated by those skilled in the art, without departing from the intended spirit and scope thereof.

The present invention is only limited by the terms of the appended claims.

The invention claimed is:

1. An acoustical array, comprising:

a) a plurality of corner reflectors mounted together in an array;

b) each corner reflector having walls with three mutually perpendicular surfaces, said surfaces including peripheral edges, at least one peripheral edge of a surface of a first corner reflector also comprising a peripheral edge of a surface of a second corner reflector adjacent said first corner reflector;

c) each corner reflector having a surface treatment which filters out sounds below a desired frequency corresponding to a low end of a frequency range for human speech;

d) each corner reflector receiving sound waves from a source of sound waves, filtering out sounds below said desired frequency and reflecting back toward said source of sound waves sounds above said desired frequency.

2. The acoustical array of claim 1, wherein each of said mutually perpendicular surfaces is triangular.

3. The acoustical array of claim 2, wherein said mutually perpendicular surfaces meet at an apex.

4. The acoustical array of claim 1, wherein each corner reflector is opaque.

5. The acoustical array of claim 4, wherein said surface treatment comprises a plurality of microperforations.

6. The acoustical array of claim 1, wherein each corner reflector is made from a material chosen from the group consisting of plastic and glass.

7. The acoustical array of claim 1, wherein said surface treatment comprises a plurality of microslits.

8. The acoustical array of claim 1, wherein said array is mounted above a space facing downward.

9. The acoustical array of claim 8, wherein said array is mounted on a ceiling.

10. The acoustical array of claim 1, wherein said array is mounted surrounding a display screen.

11. The acoustical array of claim 8, wherein said space comprises a cubicle.

12. The acoustical array of claim 8, wherein said space comprises a nursing station.

13. The acoustical array of claim 9, wherein each of said mutually perpendicular surfaces is triangular.

14. The acoustical array of claim 8, wherein each corner reflector is made from a material chosen from the group consisting of plastic and glass.

15. The acoustical array of claim 14, wherein said array is mounted beneath a lighting fixture.

16. The acoustical array of claim 15, wherein said surface treatment comprises a plurality of microslits.

17. A system, comprising:

a plurality of corner reflectors mounted together in an array and located above a space;

b) each corner reflector having walls with three mutually perpendicular triangular surfaces meeting at an apex, said surfaces including peripheral edges, at least one peripheral edge of a surface of a first corner reflector also comprising a peripheral edge of a surface of a second corner reflector adjacent said first corner reflector;

c) each corner reflector having a surface treatment which filters out sounds below a desired frequency corresponding to a low end of a frequency range for human speech;

d) each corner reflector receiving sound waves from a source of sound waves, filtering out sounds below said desired frequency and reflecting back toward said source of sound waves sounds above said desired frequency;

e) each array made of a material chosen from the group consisting of wood, plastic and glass.

18. The system of claim 17, wherein said array is mounted on a ceiling.

19. The system of claim 17, wherein said space comprises a cubicle.

20. The system of claim 17, wherein said array is mounted beneath a lighting fixture.

21. The system of claim 17, wherein said surfaces are front surfaces, and further including rear surfaces on said walls covered with a sound absorbing fabric, said front and rear surfaces being located on said walls, said walls including openings therethrough.

22. The system of claim 21, wherein said openings comprise perforations.

23. The system of claim 21, wherein said openings comprise slits.

24. An acoustical array, comprising:

a) a plurality of corner reflectors mounted together in an array;

b) each corner reflector having walls with three mutually perpendicular surfaces, said surfaces including peripheral edges, at least one peripheral edge of a surface of a first corner reflector also comprising a peripheral edge of a surface of a second corner reflector adjacent said first corner reflector;

c) each corner reflector receiving sound waves from a source of sound waves, and reflecting said sound waves back toward said source of sound waves.

25. An acoustical device, comprising:

a) a corner reflector having walls with three mutually perpendicular surfaces meeting at an apex;

b) said corner reflector having a surface treatment which filters out sounds below a desired frequency corresponding to a low end frequency range for human speech;

c) said corner reflector receiving sound waves from a source of sound waves, filtering out sounds below said desired frequency and reflecting back toward said source of sound waves above said desired frequency.

26. The acoustical device of claim 25, wherein said surface treatment comprises a plurality of microperforations.

27. The acoustical device of claim 25, wherein said surface treatment comprises a plurality of microslits.

28. The acoustical device of claim 25, wherein each of said mutually perpendicular surfaces is triangular.

29. The acoustical device of claim 25, wherein said corner reflector is made from a material chosen from the group consisting of plastic and glass.

* * * * *